United States Patent [19]

Folk

[11] 4,071,925

[45] Feb. 7, 1978

[54] APPARATUS FOR FORMING TEXTILE LAP

[75] Inventor: Craig L. Folk, New Orleans, La.

[73] Assignee: The United States of America as represented by the Secretary of Agriculture, Washington, D.C.

[21] Appl. No.: 689,772

[22] Filed: May 25, 1976

[51] Int. Cl.[2] ..... D04H 1/00

[52] U.S. Cl. ..... 19/296; 100/153

[58] Field of Search ..... 19/155, 236, 244, 105, 19/65 R, 12, 129 R, 163; 214/17 R, 17 A, 17 D; 198/625–628; 100/118–120, 151–154

[56] References Cited

U.S. PATENT DOCUMENTS

| | | | |
|---|---|---|---|
| 3,801,250 | 4/1974 | Kaiser et al. | 100/153 X |
| 3,887,063 | 6/1975 | Villanueva et al. | 198/626 |

FOREIGN PATENT DOCUMENTS

| | | | |
|---|---|---|---|
| 665,528 | 5/1929 | France | 100/152 |
| 692,483 | 7/1965 | Italy | 100/153 |
| 12,603 of | 1849 | United Kingdom | 19/129 |

*Primary Examiner*—Dorsey Newton
*Attorney, Agent, or Firm*—M. Howard Silverstein; David G. McConnell; Salvador J. Cangemi

[57] ABSTRACT

An apparatus for pressing textile fiber and tufts into lap through the use of converging belts around and between compression rollers thus improving the uniformity and surface texture of the lap is disclosed. The device comprises a series of driven rollers, belts and compression springs uniquely arranged to transform open fibers and tufts into a uniform, compressed and homogenous lap.

7 Claims, 2 Drawing Figures

APPARATUS FOR FORMING TEXTILE LAP

BACKGROUND OF THE INVENTION

1. Field of the Invention

An apparatus for improving the formation of textile lap is described. More specifically the improvements of the instant invention concerns the assembly of fibers and tufts into lap without the use of very high compression forces and the present associated massive machinery. Lap edge uniformity as well as total uniformity and smooth surface texture is achieved by compressing a column of open tufts and fibers in one direction without disturbing their arrangement in the other two plains.

2. Description of the Prior Art

Heretofore, the principal manner of lap forming was by collecting fibers and tufts on the surface of two rotating condensers. The loosely formed mat was peeled from the condensers and passed through a series of high compression rollers. Thus, the retention of the fibers and tufts into a lap was completely dependent upon the high roller compression forces.

Cross-sectional uniformity and both long and short term lap variation is dependent upon (1) the rate at which fibers and tufts are air transferred to the condenser collection chamber, and (2) the random manner in which the fibers and tufts are drawn to the surface of the condenser screen by negative air pressure within the condenser.

A number of variables which are difficult to control are inherent in the process. The non-uniformity of the vacuum pressure across the condenser screen and distribution of fiber and tufts within the condenser collection chambers are the more serious examples that contribute to the variation in cross-sectional lap weight. Long and short term variations are controlled by an averaging device that controls the amount (average thickness) of textiles being metered to the condenser chamber.

Since a conventional textile lap is produced by compressing fibers and tufts through a series of metal rollers as the textile merges from between condenser cylinders, it is the force of several very high successive compressions that is the sole means by which the lap is held together.

SUMMARY AND OBJECTS OF THE INVENTION

The instant invention relates to an apparatus for using belts and rollers to interlock fibers and tufts, and flatten the mixture into a uniform lap, and does not rely on high compression but a technique of kneading or massaging the fibers and tufts which being held and conveyed between belts passed around rollers.

Using the apparatus of the instant invention, one can achieve lap formation in a unique and unusual manner. Textile fibers can be caused to interlock by restraining the fibers between two belts in a state of moderate compression and at the same time impart a small longitudinal movement of one belt relative to the other in both directions a number of times. Fibers and tufts are held and continuously conveyed between two thin flexible belts. The belts with fibers in-between, passes between and around a series of fluted rollers. The flutes are of sufficient size so as to cause the belts with fiber sandwiched in-between to undergo reverse bending as it passes between the rollers. Additional reverse bending is achieved by a small roller whose radius approximates the flute radius of the larger belt conveyor rollers. The smaller roller oscillates upon the fluted surface of one of the larger rollers. The bending and reversal of the belt fiber sandwich causes the necessary kneading action to interlock the fibers into a lap.

It is the primary object of this invention to produce a superior lap.

It is another object of this invention to impart a smooth surface texture to the lap.

It is a third object of this invention to provide a means for varying the lap weight.

It is a fourth object of this invention to maintain uniform cross-sectional density up to the edge of the lap.

It is a fifth object of this invention to eliminate long and short term variations in lap density.

It is a sixth object of this invention to provide a means of forming lap with a simple, light-weight and low-cost machine with low energy driving force.

Other objects and advantages of this invention will further become apparent hereinafter and in the drawings in which:

DESCRIPTION OF THE PREFERRED EMBODIMENTS

Figure 1:
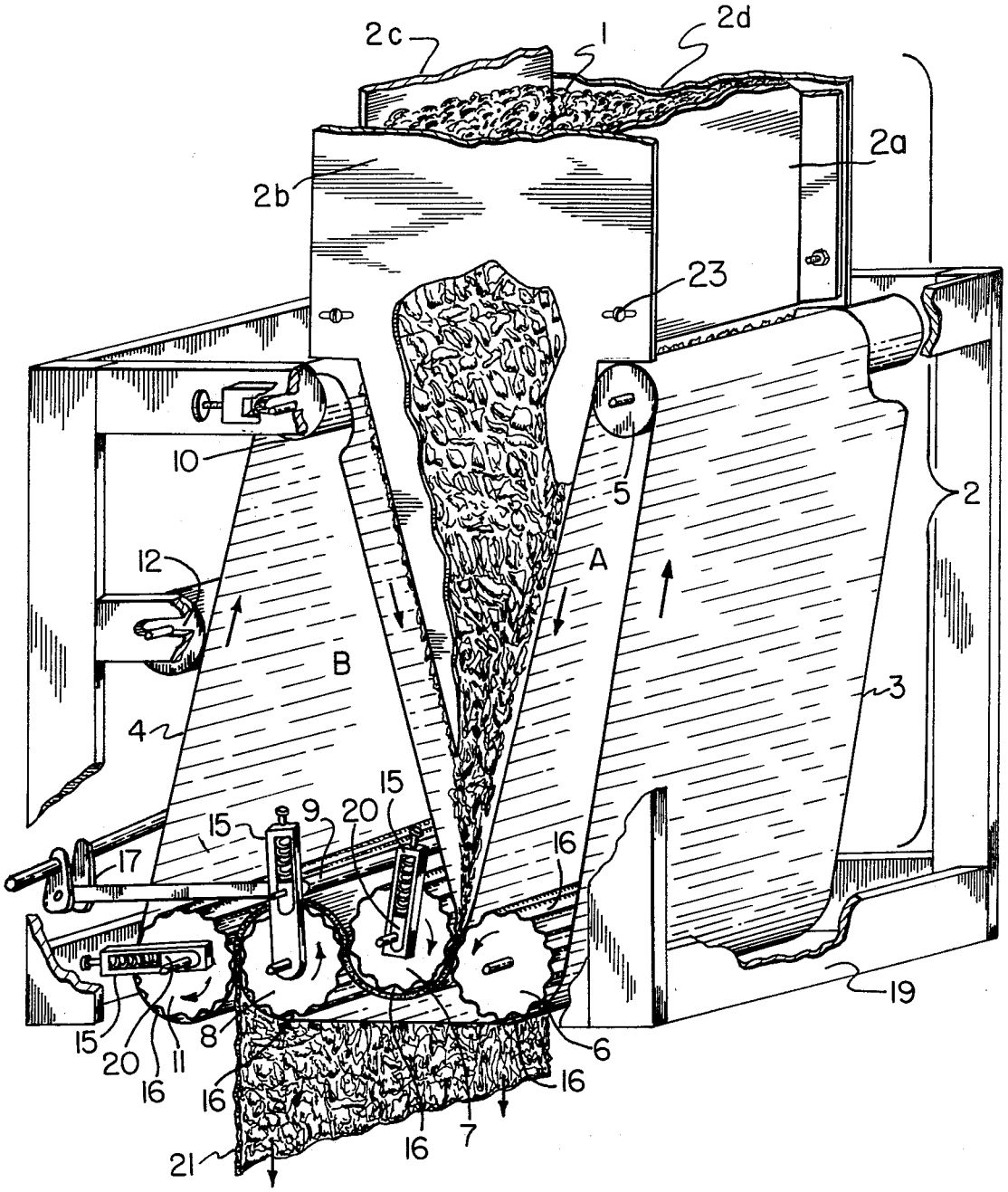
FIG. 1 is an iscmetric drawing showing fiber lap forming machine and guide entry chute.

In describing the preferred embodiment of the invention illustrated in the drawings, specific terminology will be resorted to for the sake of clarity. However, it is not intended to be limited to the specific terminology so selected, and it is to be understood that each specific term includes all technical equivalents which operate in a similar manner to accomplish a similar purpose.

Figure 2:
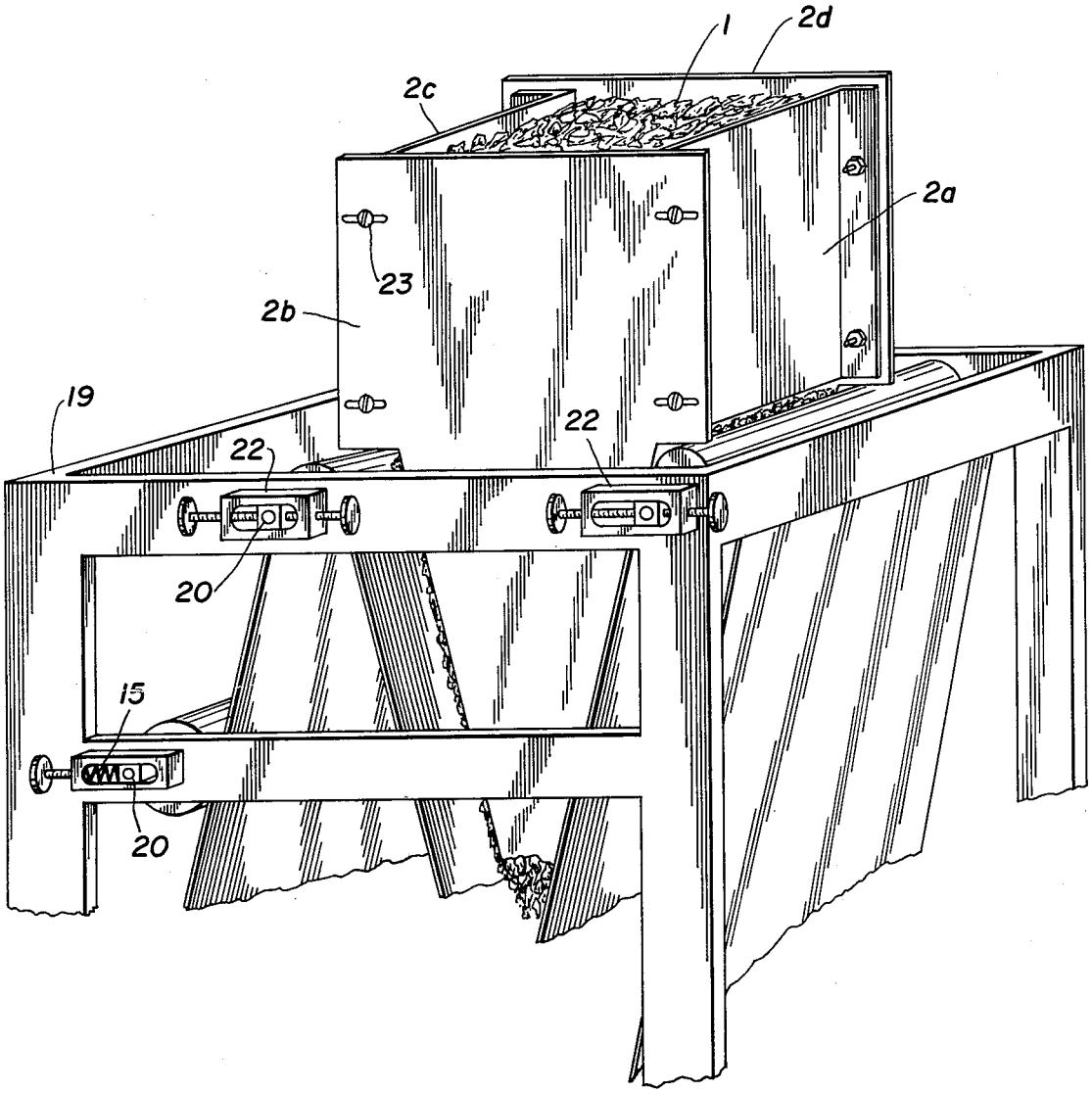
FIG. 2 is an upper external view of the lap forming machine showing the relationship of the movable sides and the method of adjusting the rollers.

Turning now to the preferred embodiment of the invention illustrated in FIG. 1, and FIG. 2, wherein individual fibers and small tufts 1 are deposited in a chute 2 and maintained at a suitable level by a sensing and control system (not shown). Chute 2, being a rectangle at the top or entrance end to a point of intersection with a first set of rollers 5 and 10. Opposing sides *2a* and *2c*, held in place by bolts 23, terminate at and are tangent to rollers 5 and 10, and are in close proximity to belts 3 and 4, and form a first set of adjusting tension rollers at the top or entrance end. Belts 3 and 4 thus form the lower section of two opposing sides of the chute which will direct and transport the incoming textile fibers and tufts. The other two opposing sides *2b* and *2d*, held in place by bolts 23, complete the upper rectangular section as well as extend down to the intersection or vertex point of belts 3 and 4 from the said tangential points, thus completing the side closures from the top of the rectangle to the point of belt intersection at rollers 6 and 7. The chute thus directs and confines the downward movement of the fibers and tufts, forming a column of fibers and tufts. This column of fibers and tufts within the chute is transported by the converging downward movement of belts 3 and 4 in the direction indicated by arrows A and B. Belts 3 and 4 with fibers and tufts 1 sandwiched in-between forms a lap between said belts which passes between roller 6 and compression roller 7. Belts 3 and 4 with fiber and tuft composition 1 sandwiched between, follows the under periphery of roller 7 and then goes between a first drive roller 8 and compression roller 7. Rollers 6,7,8, and 11, are fluted in a manner depicted by the drawing. Flutes 16 of the fluted rollers interact with each other in the same manner as gear teeth interact. This interaction causes belts 3 and 4 to follow a serpentine course as belts 3 and 4 pass between each set of rollers. The bending of belts 3 and 4 by flutes 16 causes the belts to take on a slight forward and back movement in relation to each other. It is this small displacement of belt 3 with respect to belt 4 during this moderate compression which causes the fibers and tufts 1 to interlock and remain in an apparent compressed state after exiting from the apparatus. This fiber interlocking is further increased as belts 3 and 4 pass around the upper periphery of roller 8 and between oscillating compression roller 9 which is driven by bell-crank drive 17. Oscillating roller 9, which is parallel to and adjacent roller 8, oscillates back and forth rapidly as belts 3 and 4 pass their point, resulting in a thorough massaging action on the tufts and fibers between belts 3 and 4. Belts 3 and 4 then pass between driving roller 8 and a second compression roller 11 where the belts separate and discharge the fiber and tufts composition 1 which is now in the form of a lap 21, ready for further processing. Belt 3 then follows the under periphery of roller 8 and then around the under periphery of roller 6 and back to the starting point at roller 5. Belt 4 follows the under periphery of roller 11 and then to tensioning roller 12 and around adjustable roller 10. Lap 21 is weight changeable by moving adjustable roller 5 and 10 toward and away from center of chute. The tension in belt 4 is maintained by tension roller 12. Wall 2*a* and 2*c* of chute 2 are likewise adjustable, being capable of movement toward and back from the center of the chute. Bell crank 17 and rollers 5,6,7,8,10,11, and 12, are suitably mounted in structural frame 19. Compression rollers 7,9, and 11, are mounted in movable bearing block 20, and held against rollers by spring and guide unit 15 thus forming a means of maintaining compression between the first and second rollers, the second and third rollers, and the third and fourth rollers.

The means 15,20, maintains comprssion between roller 7 and rollers 6 and 8 while the means 15,20, for roller 11 maintains compression between rollers 11 and 8.

All rollers turn in directions as indicated by arrows shown on FIG. 1.

FIG. 2 being an upper external view shows the relationship of the movable sides 2*a* and 2*c* and the method of adjusting rollers 5 and 10 corresponding amounts to achieve lap weight variation. Rollers 5 and 10 are mounted in bearing blocks 20 and are positioned by guide and adjusting screw blocks 22.

Sides 2*b* and 2*d* are slotted to allow sides 2*a* and 2*c* to adjust inwardly or outwardly toward and away from the center of the chute 1. This will allow for changes in the cross-sectional area of chute 1 and thus the density of the lap since it will feed greater amounts of fiber into belts 3 and 4 when the cross-sectional area is lessened and smaller amounts when the cross-sectional area is increased.

I claim:

1. Apparatus for pressing textile fibers and tufts into lap comprising:

a. means to lodge textile fibers and tufts between two flexible belts;

b. means to thereafter pass said belts between first and second fluted rollers, then partially around said second roller, then between said second roller and a third flutted roller, then partially around said third roller, and then between said third roller and a fourth fluted roller, c. a fifth roller, which is parallel to and adjacent said third roller at a location where said belts pass partially around said third roller, so that said belts pass between said third and fifth rollers, d. a means to oscillate said fifth roller across the upper periphery of said third roller, e. means to maintain compression between said second and first rollers, f. and to maintain compression between said second and third rollers, g. means to maintain compression between said third and fourth rollers.

2. The apparatus of claim 1 further including sixth and seventh rollers to adjust said flexible belts.

3. The apparatus of claim 2 further including an eighth roller to further adjust the tension of one of said flexible belts.

4. The apparatus of claim 2 wherein said means to lodge textile fibers and tufts between said belts is a chute comprising:

(a) a rectangle configurated consturction as the top or entrance end thereof to a point of intersection with the sixth and seventh rollers, two opposing sides of said rectangular construction terminate at and are tangent to said sixth and seventh rollers and are in close proximity to the two belts which converge downward at an angle to a point of intersection, thus completing two opposing sides of said chute, (b) the other two opposing sides complete the upper rectangular section as well as extend down to the intersection point or vertex point of the flexible belts thus completing the other two opposing sides of the chute.

5. The apparatus of claim 4 wherein the chute sides are slotted and bolted to allow for inward and outward adjustment of the cross-sectional area of said chute.

6. The apparatus of claim 2 wherein the second, fourth, and fifth rollers are mounted in movable bearing blocks and held in compression by a spring and guide unit.

7. The apparatus of claim 1 wherein the fifth roller is driven by a bell crank drive.

* * * * *